US007786940B2

(12) United States Patent
Hirano

(10) Patent No.: US 7,786,940 B2
(45) Date of Patent: Aug. 31, 2010

(54) ANTENNA STRUCTURE AND WIRELESS COMMUNICATION DEVICE INCLUDING THE SAME

(75) Inventor: Satoru Hirano, Nomi-gun (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 496 days.

(21) Appl. No.: 11/873,633

(22) Filed: Oct. 17, 2007

(65) Prior Publication Data

US 2009/0303144 A1 Dec. 10, 2009

Related U.S. Application Data

(63) Continuation of application No. PCT/JP2005/012680, filed on Jul. 8, 2005.

(30) Foreign Application Priority Data

May 11, 2005 (JP) ..... 2005-138725

(51) Int. Cl.
*H01Q 1/24* (2006.01)

(52) U.S. Cl. ..... 343/702; 343/700 MS

(58) Field of Classification Search ..... 343/702, 343/700 MS, 750, 846, 848
See application file for complete search history.

(56) References Cited

U.S. PATENT DOCUMENTS 6,177,908 B1 1/2001 Kawahata et al.
6,614,398 B2 * 9/2003 Kushihi et al. ..... 343/700 MS
6,653,986 B2 11/2003 Watada et al.
6,700,543 B2 * 3/2004 Konishi et al. ..... 343/700 MS
7,136,020 B2 * 11/2006 Yamaki ..... 343/702
2002/0101382 A1 * 8/2002 Konishi et al. ..... 343/702

FOREIGN PATENT DOCUMENTS

| | | | |
|---|---|---|---|
| JP | 3-22416 | U | 3/1991 |
| JP | 4-114205 | U | 10/1992 |
| JP | 05-299927 | A | 11/1993 |
| JP | 08-222016 | A | 8/1996 |
| JP | 10-173426 | A | 6/1998 |
| JP | 2001-332924 | A | 11/2001 |
| JP | 2005-005985 | A | 1/2005 |

OTHER PUBLICATIONS

Official communication issued in the International Application No. PCT/JP2005/012680, mailed on Aug. 23, 2005.
Official communication issued in the counterpart Japanese Application No. JP 2007-505312, mailed on Apr. 17, 2007.

* cited by examiner

*Primary Examiner*—HoangAnh T Le
(74) *Attorney, Agent, or Firm*—Keating & Bennett, LLP

(57) ABSTRACT

A capacitive-power-feeding-type radiating electrode is provided on a dielectric substrate, and the dielectric substrate is provided in a non-ground region of a circuit board. In the non-ground region of the circuit board, a ground line electrically connecting the radiating electrode with a ground electrode of the circuit board is provided. The ground line is shaped so as to have at least one turnback portion. On the ground line, a resonant-frequency adjusting element is arranged so as to shortcut a portion of the ground line. The resonant-frequency adjusting element has a capacitance or inductance so as to adjust a resonant frequency of an antenna structure to a predetermined resonant frequency.

3 Claims, 5 Drawing Sheets

ANTENNA STRUCTURE AND WIRELESS COMMUNICATION DEVICE INCLUDING THE SAME

BACKGROUND OF THE INVENTION

1. Field of the Invention

The present invention relates to an antenna structure including a capacitive-power-feeding-type radiating electrode and to a wireless communication device including the antenna structure.

2. Description of the Related Art

As a type of antenna provided on a wireless communication device, a surface-mount antenna that is mounted on a circuit board of a wireless communication device and contained and disposed within a case of the wireless communication device exists. In the surface-mount antenna, for example, a radiating electrode that performs an antenna operation is formed on a dielectric substrate.

The frequency characteristics of radio waves of a wireless communication device in which a surface-mount antenna is mounted on a circuit board are not determined only by a radiating electrode of the surface-mount antenna, but are determined by various factors such as a ground electrode or portions of the circuit board having mounted the surface-mount antenna thereon. Thus, the resonant frequency of radio waves for wireless communications carried out by a wireless communication device differs from the resonant frequency of the radiating electrode of the surface-mount antenna. Thus, even when the same surface-mount antenna is mounted, for example, when the type of wireless communication device varies, problematically, the resonant frequency of radio waves for wireless communications carried out by the wireless communication device (hereinafter referred to as the resonant frequency of the antenna) varies.

That is, the peripheral conditions of the surface-mount antenna vary when the type of wireless communication device varies. For example, the size or shape of a ground electrode formed on the circuit board varies, the types of components disposed in the periphery of the surface-mount antenna or the gaps between the surface-mount antenna and peripheral components vary, or the material of the case of the wireless communication device varies. The resonant frequency of the antenna is determined by complex effects of such peripheral conditions of the surface-mount antenna. Thus, when the type of the circuit board having the surface-mount antenna mounted thereon varies so that the peripheral conditions of the surface-mount antenna varies, the resonant frequency of the antenna varies even when the same surface-mount antenna is provided.

As described above, even when the same surface-mount antenna is provided, it is not possible to achieve the same resonant frequency of the antenna when the type of wireless communication device varies. Thus, even when the desired resonant frequency of the antenna is the same, for example, when the type of wireless communication device varies, it is not possible to provide the same surface-mount antenna. Therefore, it is necessary to prepare a custom design of factors such as the size of the radiating electrode of the surface-mount antenna for each type of wireless communication device, which is laborious. According to another method that has been proposed (see, for example, Japanese Unexamined Patent Application Publication No. 10-173426; Japanese Unexamined Patent Application Publication No. 11-312919; and Japanese Unexamined Patent Application Publication No. 2002-335117), the resonant frequency of an antenna is adjusted to a predetermined resonant frequency by preparing custom designs not for a surface-mount antenna but for portions other than the surface-mount antenna, for example, by changing a circuit on a circuit board that is electrically connected to the surface-mount antenna for each type of wireless communication device.

However, according to the method that has been used, in which the resonant frequency of an antenna is adjusted by a circuit on a circuit board, problematically, current loss increases and antenna gain decreases. Furthermore, when a component having a capacitance or an inductance is used for adjusting the resonant frequency of an antenna, if a generic component is used in view of cost, the magnitude of the capacitance or the value of the inductance of the generic component can only be chosen from several predetermined values. That is, in many cases, it is not possible to obtain a capacitor component or an inductor component having an optimal value, so that it has been difficult to adjust the resonant frequency of an antenna precisely to a predetermined resonant frequency.

SUMMARY OF THE INVENTION

In order to overcome the problems described above, preferred embodiments of the present invention provide the following constructions to solve the problems with conventional devices.

That is, a construction of an antenna structure according to a preferred embodiment of the present invention includes a capacitive-power-feeding-type radiating electrode that performs an antenna operation and is provided on a substrate, the substrate is mounted in a non-ground region of a circuit board, and a ground line arranged to electrically connect a ground electrode provided on the circuit board and adjacent to the non-ground region with the radiating electrode of the substrate is provided in the non-ground region of the circuit board with the substrate mounted thereon, wherein the ground line is configured so as to have at least one turnback portion, a resonant-frequency adjusting element is provided on the ground line so as to connect adjacent line portions having a gap therebetween formed by the turnback of the line at the turnback portion and thereby shortcut a portion of the ground line, and the resonant-frequency adjusting element has a capacitance or inductance so as to adjust a resonant frequency of the antenna structure to a predetermined resonant frequency.

Furthermore, a construction of a wireless communication device according to another preferred embodiment of the present invention includes the antenna structure described above.

According to a preferred embodiment of the present invention, the ground line is configured so as to have at least one turnback portion, and the resonant-frequency adjusting element is provided on the ground line so as to connect the adjacent line portions via a gap formed by the turnback of the line at the turnback portion and thereby shortcut a portion of the ground line. With this construction, a portion of a high-frequency current that flows through the ground line flows through a path passing through the resonant-frequency adjusting element and shortcuts a portion of the ground line. Thus, in accordance with the length of shortcut of the ground line by the high-frequency current that flows through the resonant-frequency adjusting element, the electrical length of the ground line decreases. That is, by adjusting the position where the resonant-frequency adjusting element is disposed, it is possible to change the length of shortcut of the ground line by the high-frequency current that flows through the resonant-frequency adjusting element and to thereby change the electrical length of the ground line. Accordingly, simply by adjusting the position where the resonant-frequency adjusting element is disposed without changing the physical length of the ground line, it is possible to change and adjust the electrical length of the ground line and to thereby change and adjust the resonant frequency of the antenna structure.

Furthermore, since the resonant-frequency adjusting element has a capacitance or an inductance, it is also possible to change and adjust the electrical length of the ground line and to thereby change and adjust the resonant frequency of the antenna structure by changing and adjusting the magnitude of the capacitance or the value of the inductance.

That is, with the construction according to a preferred embodiment of the present invention, it is possible to change and adjust the resonant frequency of the antenna structure simply by changing and adjusting the position where the resonant-frequency adjusting element is disposed or the magnitude of capacitance or the value of inductance of the resonant-frequency adjusting element without changing factors such as the size or shape of the radiating electrode on the substrate or the length, shape, or width of the ground line. Thus, it is possible to commonly use a component (antenna component) in which a radiating electrode is disposed on a substrate for a plurality of types of wireless communication device, and this serves for use of common components. Accordingly, the cost of an antenna component or a wireless communication device can be readily reduced.

Furthermore, according to a preferred embodiment of the present invention, the resonant-frequency adjusting element is arranged parallel or substantially parallel to a portion of the ground line. Thus, an increase in loss of a high-frequency current can be prevented, and reduction in an antenna gain can be prevented accordingly.

By providing the antenna structure exhibiting such favorable effects in a wireless communication device, it is possible to provide a wireless communication device that exhibits good performance of wireless communications and high reliability of wireless communications.

Other features, elements, steps, characteristics and advantages of the present invention will become more apparent from the following detailed description of preferred embodiments of the present invention with reference to the attached drawings.

DETAILED DESCRIPTION OF THE PREFERRED EMBODIMENTS

Now, preferred embodiments of the present invention will be described with reference to the drawings.

Figure 1A:
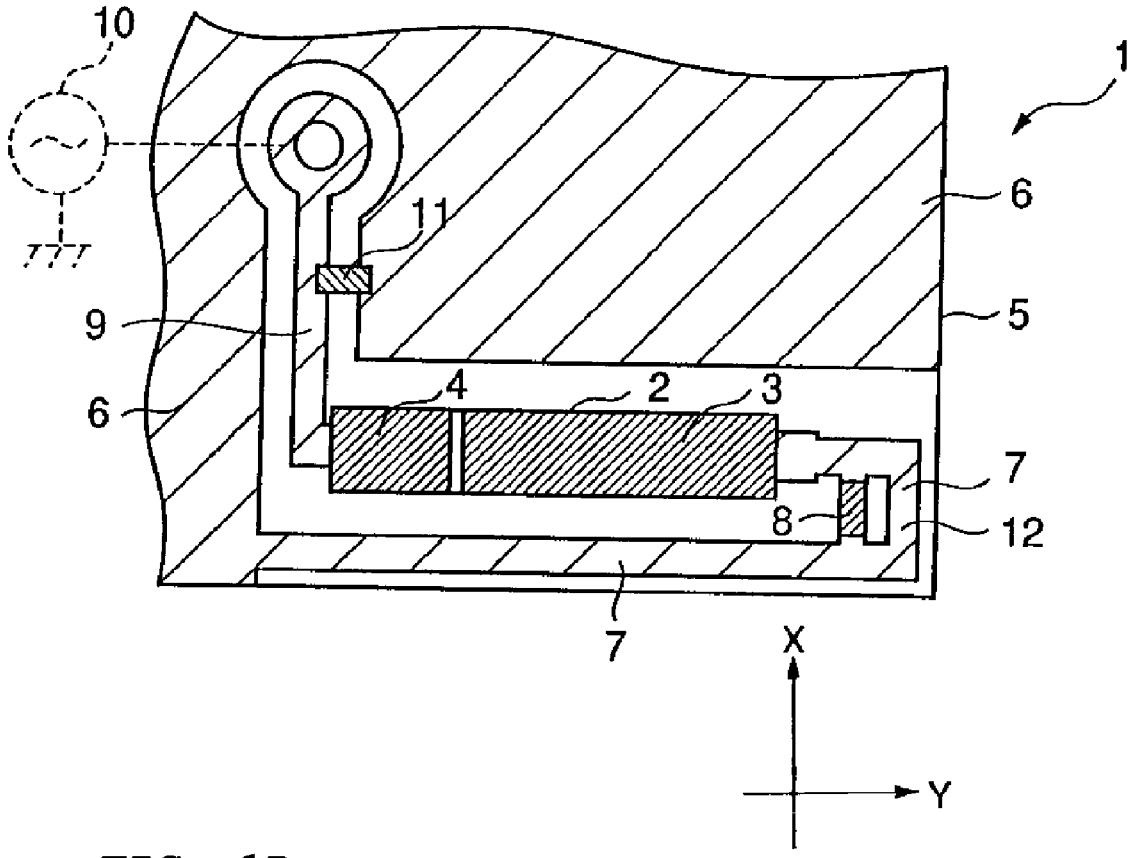
FIG. 1A is a schematic plan view for explaining an antenna structure according to a first preferred embodiment of the present invention.
Figure 1B:
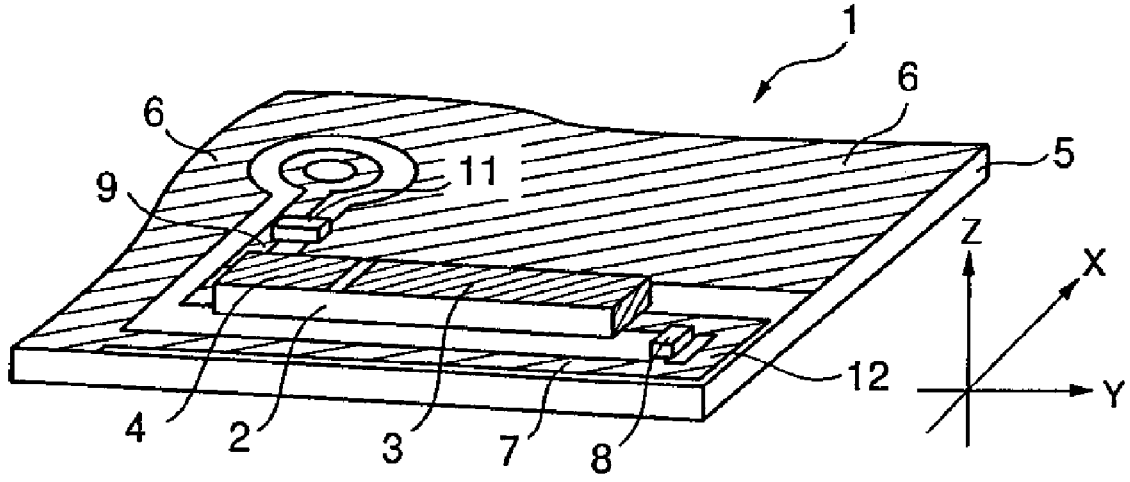
FIG. 1B is a schematic perspective view of the antenna structure shown in FIG. 1A.
Figure 1C:
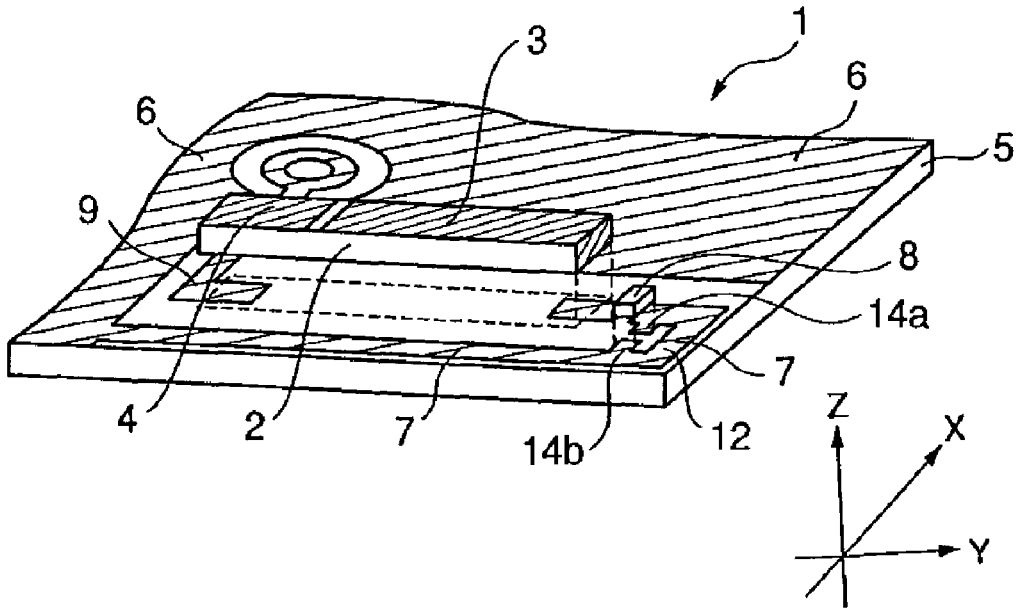
FIG. 1C is a schematic exploded view of the antenna structure shown in FIG. 1B.

FIG. 1A is a schematic plan view showing a first preferred embodiment of an antenna structure according to the present invention. FIG. 1B is a schematic perspective view of the antenna structure shown in FIG. 1A. FIG. 1C is a schematic exploded view of the antenna structure shown in FIG. 1B.

An antenna structure 1 according to the first preferred embodiment includes a substrate 2 preferably made of a dielectric material, a radiating electrode 3 and a power-feeding electrode 4 disposed on the dielectric substrate 2, a circuit board 5 on which the dielectric substrate 2 is surface-mounted, a ground electrode 6 disposed on the circuit board 5, a ground line 7 arranged on the circuit board 5 so that the radiating electrode 3 of the dielectric substrate 2 is electrically connected to the ground electrode 6 of the circuit board 5, a resonant-frequency adjusting element 8 disposed on the ground line 7, and a power-feeding line 9 disposed on the circuit board 5 and electrically connected to the power-feeding electrode 4 of the dielectric substrate 2.

In the first preferred embodiment, the dielectric substrate 2 preferably has a substantially rectangular-parallelepiped shape, and the radiating electrode 3 is arranged so as to extend from a top surface to the bottom surface of the dielectric substrate 2, for example, via the right-end surface as viewed in FIG. 1B. Furthermore, the power-feeding electrode 4 is arranged so as to extend from the bottom surface of the dielectric substrate 2 to a position opposing the radiating electrode 3 with a gap on the top surface of the dielectric substrate 2, for example, via the left-end surface as viewed in FIG. 1B.

A corner portion of the circuit board 5 constitutes an antenna constituting portion, and the corner portion constitutes a non-ground region where the ground electrode 6 is not located. In a predetermined substrate-disposing region of the non-ground region, the dielectric substrate 2 having the radiating electrode 3 and the power-feeding electrode 4 disposed thereon is mounted. The power-feeding line 9 is disposed in the non-ground region of the antenna constituting portion of the circuit board 5. One end of the power-feeding line 9 is arranged so as to extend into the substrate disposing region and is electrically connected to the power-feeding electrode 4. The other end of the power-feeding line 9 is electrically connected to, for example, a high-frequency circuit 10 for wireless communications by a wireless communication device. That is, the power-feeding line 9 electrically connects the high-frequency circuit 10 for wireless communications with the power-feeding electrode 4. On the power-feeding line 9, a matching element 11 constituting a matching circuit for impedance matching between the side of the power-feeding electrode 4 and the side of the high-frequency circuit 10 is provided.

The power-feeding electrode 4 is arranged with a gap so as to be spaced from the radiating electrode 3, and the power-feeding electrode 4 is electromagnetically coupled with the radiating electrode 3 via a capacitive coupling therebetween. That is, for example, when signals for wireless transmission are transmitted from the high-frequency circuit 10 to the power-feeding electrode 4 via the power-feeding line 9, the signals for wireless transmission are transmitted from the power-feeding electrode 4 to the radiating electrode 3 by the capacitive coupling between the power-feeding electrode 4 and the radiating electrode 3. That is, the radiating electrode 3 constitutes a capacitive-power-feeding-type radiating electrode.

The ground electrode 6 is arranged substantially over the entire region of the circuit board 5 but avoiding the non-ground region of the corner portion of the circuit board 5, which is an antenna constituting portion. The ground line 7 electrically connecting the ground electrode 6 with the radiating electrode 3 is disposed in the non-ground region of the circuit board 5.

In the first preferred embodiment, the ground line 7 is preferably defined by a substantially U-shaped strip line having one turnback portion 12. On the ground line 7, the resonant-frequency adjusting element 8 is disposed so as to connect adjacent line portions via a gap therebetween formed by the turnback of the line at the turnback portion 12 and thereby shortcut a portion of the ground line 7. In the first preferred embodiment, between the line portions arranged in parallel or substantially in parallel, and extending toward and extending away from the turnback portion 12, a position for disposing the resonant-frequency adjusting element 8 is predetermined. At the predetermined position, lands 14*a* and 14*b* (FIG. 1C) are provided individually for the line portions extending toward and extending away. The resonant-frequency adjusting element 8 is bonded to the lands 14*a* and 14*b* preferably with a conductive bonding material such as solder and is thereby electrically connected to the ground line 7.

The resonant-frequency adjusting element 8 is preferably implemented by a capacitor component or an inductor component, and it serves to adjust the resonant frequency of the antenna structure 1. That is, the resonant frequency of the antenna structure 1 is not determined only by the resonant frequency of the radiating electrode 3, but is also affected by other factors, such as the length and width of the ground line 7. By disposing the resonant-frequency adjusting element 8 on the ground line 7, a portion of a high-frequency current that flows through the ground line 7 flows through a path that shortcuts the ground line 7 via the resonant-frequency adjusting element 8. Thus, by changing the position where the resonant-frequency adjusting element 8 is disposed, the amount of shortcut of the ground line 7 by the high-frequency current changes, so that the electrical length of the ground line 7 changes. Furthermore, since the resonant-frequency adjusting element 8 is preferably implemented by a capacitor component or an inductor component, the electrical length of the ground line 7 also changes depending on the magnitude of capacitance or the value of inductance of the resonant-frequency adjusting element 8.

As the electrical length of the ground line 7 increases, the resonant frequency of the antenna structure 1 decreases. That is, as the electrical length of the ground line 7 decreases, the resonant frequency of the antenna structure 1 increases. Thus, it is possible to adjust the resonant frequency of the antenna structure 1 by changing the position of disposing the resonant-frequency adjusting element 8 or the magnitude of capacitance or the value of inductance of the resonant-frequency adjusting element 8 and thereby changing and adjusting the electrical length of the ground line 7.

Figure 2:
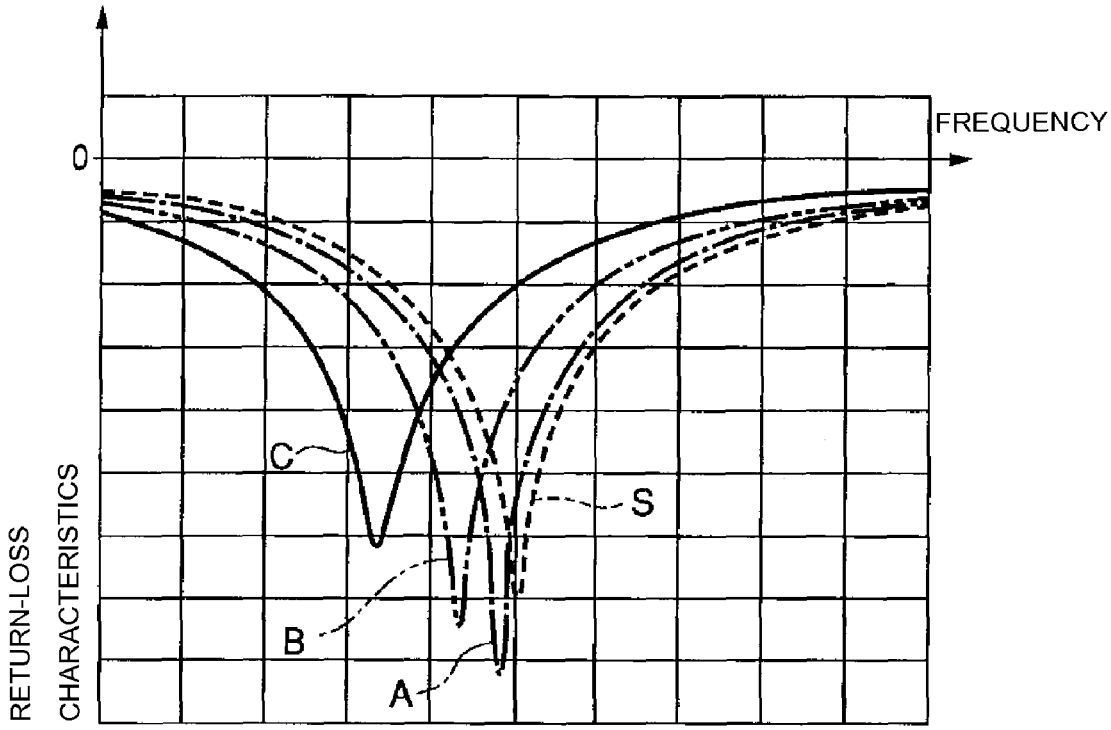
FIG. 2 is a graph showing an example of relationship between the magnitude of capacitance of a resonant-frequency adjusting element and the resonant frequency of an antenna structure in a case where a capacitor component is provided as the resonant-frequency adjusting element.

When the resonant-frequency adjusting element 8 is implemented by a capacitor component, compared with a case where the resonant-frequency adjusting element 8 is not disposed on the ground line 7, the resonant frequency of the antenna structure 1 can be decreased. Furthermore, even when the position where the resonant-frequency adjusting element 8 is disposed is the same, the electrical length of the ground line 7 can be increased in accordance with an increase in the magnitude of capacitance of the resonant-frequency adjusting element 8, which is a capacitor component, so that the resonant frequency of the antenna structure 1 can be decreased accordingly. A graph in FIG. 2 shows examples of return-loss characteristics of four types of the antenna structure 1 that are constructed the same except for the arrangement of the resonant-frequency adjusting element 8. More specifically, a dotted line S in the graph in FIG. 2 represents an example of return-loss characteristics of the antenna structure 1 in a case where the resonant-frequency adjusting element 8 is not provided. On the other hand, a chain line A, a chain line B, and a solid line C represent examples of return-loss characteristics of the antenna structure 1 in cases where a capacitor component is provided as the resonant-frequency adjusting element 8. The chain line A represents an example where the capacitance of the resonant-frequency adjusting element 8 is about 0.7 pF, the chain line B represents an example where the capacitance of the resonant-frequency adjusting element 8 is about 1.0 pF, and the solid line C represents an example where the capacitance of the resonant-frequency adjusting element 8 is about 1.5 pF. As will be understood from the graph in FIG. 2, the resonant frequency of the antenna structure 1 can be decreased as the capacitance of the resonant-frequency adjusting element 8 is increased.

When the resonant-frequency adjusting element 8 is implemented by an inductor component, compared with a case where the resonant-frequency adjusting element 8 is not disposed on the ground line 7, the resonant frequency of the antenna structure 1 can be increased. Furthermore, even when the position where the resonant-frequency adjusting element 8 is disposed is the same, the effect of the resonant-frequency adjusting element 8 on the ground line 7 increases in accordance with decrease in the value of inductance of the resonant-frequency adjusting element 8 (inductor component). Thus, the electrical length of the ground line 7 decreases, so that the resonant frequency of the antenna structure 1 increases.

Figure 3:
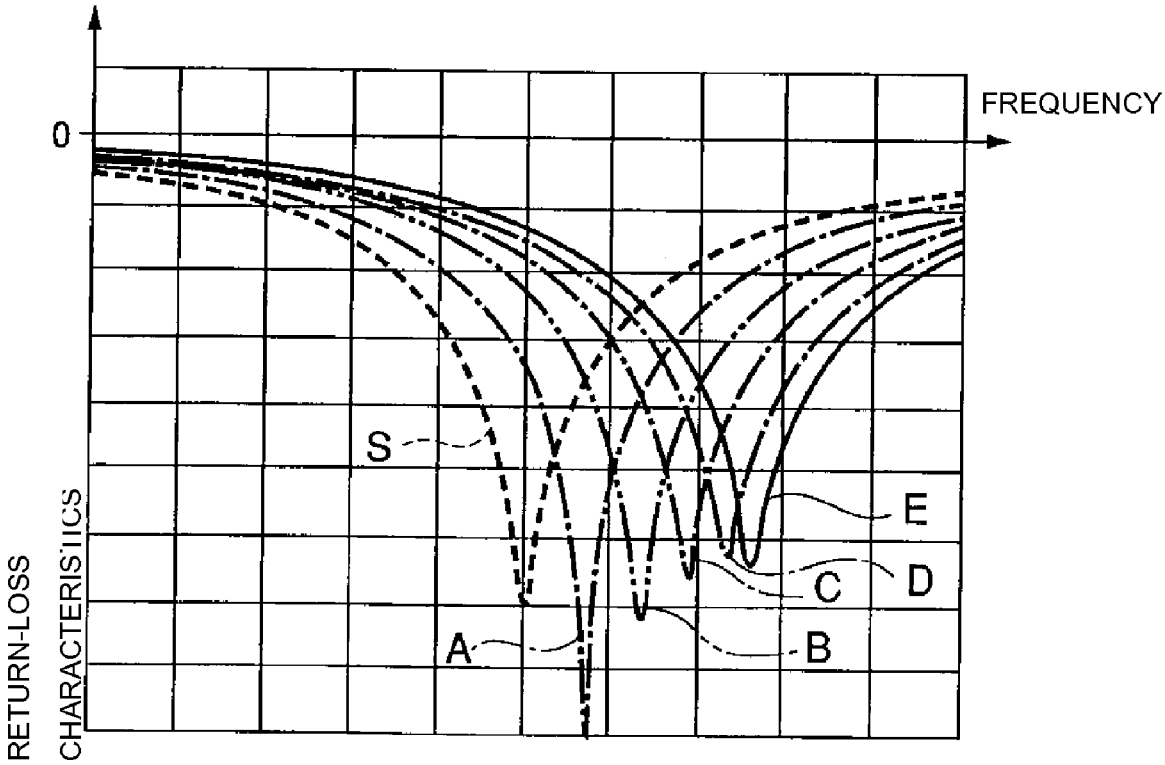
FIG. 3 is a graph showing an example of relationship between the value of inductance of a resonant-frequency adjusting element and the resonant frequency of an antenna structure in a case where an inductor component is provided as the resonant-frequency adjusting element.

A graph in FIG. 3 shows examples of return-loss characteristics of six types of the antenna structure 1 that are constructed the same except for the arrangement of the resonant-frequency adjusting element 8. More specifically, a dotted line S in the graph in FIG. 3 represents an example of return-loss characteristics of the antenna structure 1 in a case where the resonant-frequency adjusting element 8 is not provided.

On the other hand, chain lines A to D and a solid line E in the graph in FIG. 3 represent examples of return-loss characteristics of the antenna structure 1 in cases where an inductor component is provided as the resonant-frequency adjusting element 8. The chain line A represents an example where the value of inductance of the resonant-frequency adjusting element 8 is about 22 nH, the chain line B represents an example where the value of inductance of the resonant-frequency adjusting element 8 is about 12 nH, the chain line C represents an example where the value of inductance of the resonant-frequency adjusting element 8 is about 8.2 nH, the chain line D represents an example where the value of inductance of the resonant-frequency adjusting element 8 is about 6.8 nH, and the solid line E represents an example where the value of inductance of the resonant-frequency adjusting element 8 is about 4.7 nH. As will be understood from the graph in FIG. 3, when an inductor component is provided as the resonant-frequency adjusting element 8, the resonant frequency of the antenna structure 1 increases as the value of inductance of the resonant-frequency adjusting element 8 decreases.

In the first preferred embodiment, in consideration of what has been described above, the position where the resonant-frequency adjusting element 8 is disposed and the magnitude of capacitance or the value of inductance of the resonant-frequency adjusting element 8 are preferably determined so that the resonant frequency of the antenna structure 1 is set to a predetermined resonant frequency.

With the arrangement of the first preferred embodiment, advantageously, it is possible to adjust the resonant frequency of the antenna structure 1 to a predetermined resonant frequency simply by changing and adjusting the disposing position, capacitance, or inductance value of the resonant-frequency adjusting element 8 without changing factors such as the size or shape of the radiating electrode 3 or the physical length or width of the ground line 7.

Furthermore, when a general-purpose capacitor component or inductor component is used as the resonant-frequency adjusting element 8, although the magnitude of capacitance or the value of inductance of the resonant-frequency adjusting element 8 can only be changed and adjusted discontinuously, the position where the resonant-frequency adjusting element 8 is disposed can be changed continuously. Thus, by allowing changing and adjusting the position where the resonant-frequency adjusting element 8 is disposed as well as changing and adjusting the capacitance or the inductance value of the resonant-frequency adjusting element 8, it is possible to delicately adjust the resonant frequency of the antenna structure 1, so that it becomes readily possible to adjust the resonant frequency of the antenna structure 1 to a predetermined resonant frequency.

Furthermore, since the resonant-frequency adjusting element 8 is provided in parallel or substantially in parallel to a portion of the ground line 7, it is possible to prevent increases in loss of a high-frequency current. Thus, even when the resonant-frequency adjusting element 8 is provided on the ground line 7, variations in antenna gain can be minimized. This has been verified through experiments by the inventor. In the experiments, three samples α, β, and γ having the same conditions except for the arrangement of the resonant-frequency adjusting element 8 were prepared. More specifically, in the sample α, the resonant-frequency adjusting element 8 was not provided. In the sample β, a capacitor part having a capacitance of, for example, about 1.5 pF was provided as the resonant-frequency adjusting element 8. In the sample γ, an inductance part having an inductance value of, for example, about 12 nH was provided as the resonant-frequency adjusting element 8. For each of these samples α, β, and γ, antenna gains for linearly polarized waves and circularly polarized waves were obtained. The results of the experiments are shown in Tables 1 to 6. Table 1 relates to linearly polarized waves of the sample α, Table 2 relates to linearly polarized waves of the sample β, and Table 3 relates to linearly polarized waves of the sample γ. Table 4 relates to circularly polarized waves of the sample α, Table 5 relates to circularly polarized waves of the sample β, and Table 6 relates to circularly polarized waves of the sample γ.

TABLE 1

| | | YZ plane | | ZX plane | | |
|---|---|---|---|---|---|---|
| Sample α | | Horizontally polarized waves | Vertically polarized waves | Horizontally polarized waves | Vertically polarized waves | Spatial average value |
| 1565 MHz | Maximum value (dBi) | −0.7 | −10.6 | −0.1 | −2.6 | |
| | Average value (dBi) | −3.1 | −14.2 | −4.1 | −5.2 | −2.0 |
| 1575 MHz | Maximum value (dBi) | −0.5 | −9.9 | 0.3 | −2.0 | |
| | Average value (dBi) | −2.8 | −13.5 | −3.8 | −4.6 | −1.6 |
| 1585 MHz | Maximum value (dBi) | −0.8 | −9.8 | 0.3 | −1.8 | |
| | Average value (dBi) | −3.0 | −13.4 | −3.9 | −4.4 | −1.7 |

TABLE 2

| Sample β | | YZ plane Horizontally polarized waves | YZ plane Vertically polarized waves | ZX plane Horizontally polarized waves | ZX plane Vertically polarized waves | Spatial average value |
|---|---|---|---|---|---|---|
| 1565 MHz | Maximum value (dBi) | −0.9 | −10.8 | −0.4 | −2.9 | |
| | Average value (dBi) | −3.3 | −14.5 | −4.4 | −5.5 | −2.3 |
| 1575 MHz | Maximum value (dBi) | −0.6 | −10.0 | 0.1 | −2.2 | |
| | Average value (dBi) | −2.9 | −13.8 | −4.0 | −4.8 | −1.8 |
| 1585 MHz | Maximum value (dBi) | −0.9 | −9.8 | 0.1 | −1.9 | |
| | Average value (dBi) | −3.1 | −13.6 | −4.1 | −4.6 | −1.8 |

TABLE 3

| Sample γ | | YZ plane Horizontally polarized waves | YZ plane Vertically polarized waves | ZX plane Horizontally polarized waves | ZX plane Vertically polarized waves | Spatial average value |
|---|---|---|---|---|---|---|
| 1565 MHz | Maximum value (dBi) | −0.7 | −10.7 | −0.2 | −2.8 | |
| | Average value (dBi) | −3.1 | −14.3 | −4.2 | −5.4 | −2.1 |
| 1575 MHz | Maximum value (dBi) | −0.5 | −10.0 | 0.2 | −2.1 | |
| | Average value (dBi) | −2.8 | −13.6 | −3.9 | −4.8 | −1.7 |
| 1585 MHz | Maximum value (dBi) | −0.8 | −9.9 | 0.2 | −1.9 | |
| | Average value (dBi) | −2.9 | −13.4 | −3.9 | −4.5 | −1.7 |

TABLE 4

| Sample α | | YZ plane R.H.C.P. | ZX plane R.H.C.P. | Spatial average value |
|---|---|---|---|---|
| 1565 MHz | Maximum value (dBi) | −2.5 | −1.3 | |
| | Average value (dBi) | −4.4 | −4.6 | −4.5 |
| 1575 MHz | Maximum value (dBi) | −2.4 | −0.9 | |
| | Average value (dBi) | −4.1 | −4.1 | −4.1 |
| 1585 MHz | Maximum value (dBi) | −2.8 | −0.9 | |
| | Average value (dBi) | −4.2 | −4.0 | −4.2 |

TABLE 5

| Sample β | | YZ plane R.H.C.P. | ZX plane R.H.C.P. | Spatial average value |
|---|---|---|---|---|
| 1565 MHz | Maximum value (dBi) | −2.8 | −1.7 | |
| | Average value (dBi) | −4.7 | −4.9 | −4.7 |
| 1575 MHz | Maximum value (dBi) | −2.5 | −1.1 | |
| | Average value (dBi) | −4.2 | −4.3 | −4.2 |
| 1585 MHz | Maximum value (dBi) | −2.8 | −1.0 | |
| | Average value (dBi) | −4.3 | −4.2 | −4.2 |

TABLE 6

| Sample γ | | YZ plane R.H.C.P. | ZX plane R.H.C.P. | Spatial average value |
|---|---|---|---|---|
| 1565 MHz | Maximum value (dBi) | −2.4 | −1.5 | |
| | Average value (dBi) | −4.4 | −4.7 | −4.5 |
| 1575 MHz | Maximum value (dBi) | −2.2 | −1.1 | |
| | Average value (dBi) | −4.0 | −4.2 | −4.0 |
| 1585 MHz | Maximum value (dBi) | −2.5 | −0.9 | |
| | Average value (dBi) | −4.1 | −4.0 | −4.0 |

As will be understood from a comparison between Table 1 showing antenna gains for linearly polarized waves in the sample α (in which the resonant-frequency adjusting element 8 is not provided) and Tables 2 and 3 showing antenna gains for linearly polarized waves in the samples β and γ (in which the resonant-frequency adjusting element 8 is provided), and a comparison between Table 4 showing antenna gains for circularly polarized waves in the sample α and Tables 5 and 6 showing antenna gains for circularly polarized waves in the samples β and γ, it was confirmed that even when the resonant-frequency adjusting element 8 was provided on the ground line 7, antenna gains similar to those in cases where the resonant-frequency adjusting element 8 was not provided were obtained.

Now, a second preferred embodiment will be described. In the description of the second preferred embodiment, elements corresponding to those in the first preferred embodiment are designated by the same reference numerals, and repeated descriptions of the corresponding elements will be omitted.

In the second preferred embodiment, between the line portions provided in parallel or substantially in parallel and extending toward and extending away from the turnback portion 12 of the ground line 7, a plurality of positions for disposing the resonant-frequency adjusting element 8 is predetermined. At the predetermined positions for disposing the resonant-frequency adjusting element 8, lands 15 to 17 for electrically connecting the resonant-frequency adjusting element 8 with the ground line 7 are individually provided, as shown in a schematic enlarged plan view in FIG. 4.

Figure 4:
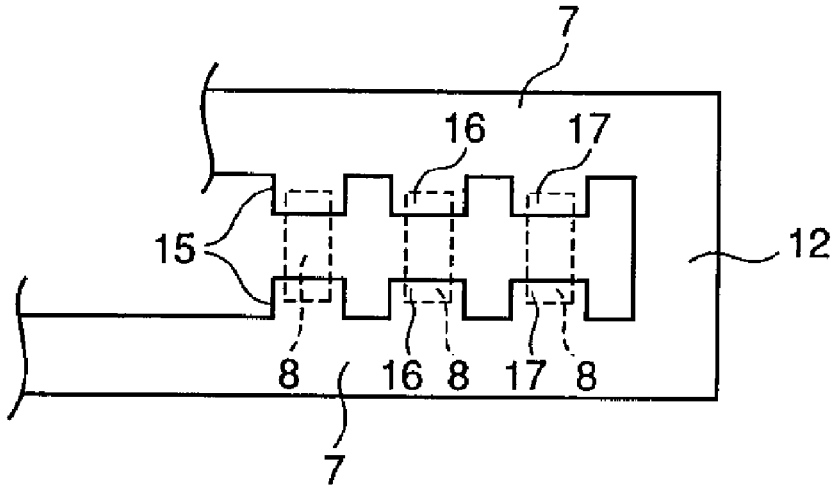
FIG. 4 is a diagram for explaining an antenna structure according to a second preferred embodiment of the present invention.
Figure 6A:
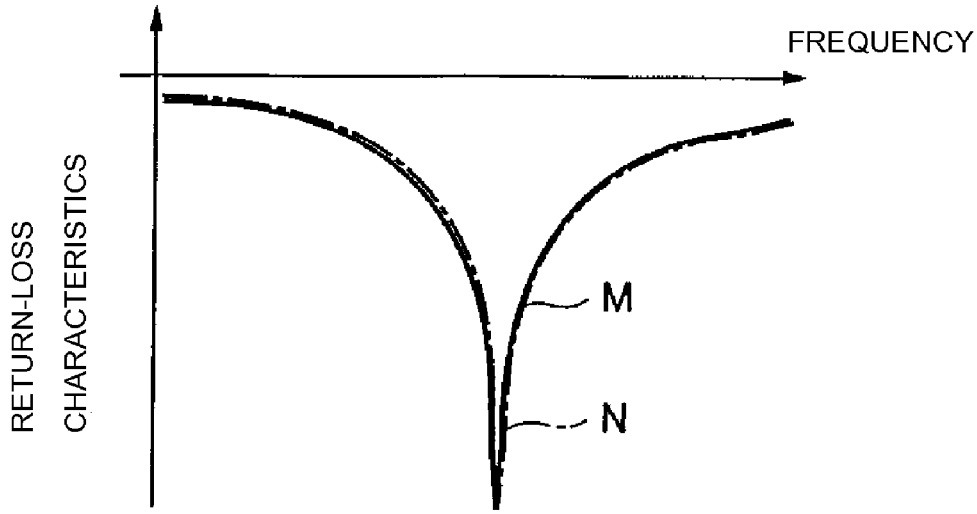
FIG. 6A is a graph for explaining, together with FIGS. 6B and 6C, an example of the relationship between the position of disposing a resonant-frequency adjusting element and the resonant frequency of an antenna structure in a case where a capacitor component is provided as the resonant-frequency adjusting element.
Figure 6B:
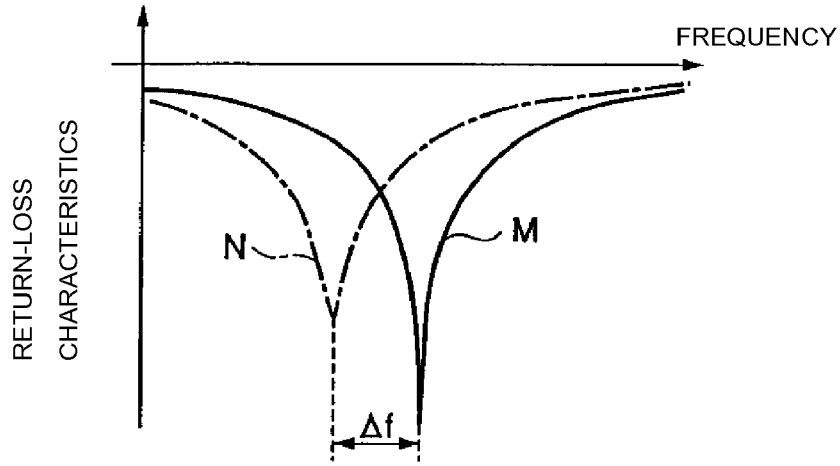
FIG. 6B is a graph for explaining, together with FIGS. 6B and 6C, an example of the relationship between the position of disposing a resonant-frequency adjusting element and the resonant frequency of an antenna structure in a case where a capacitor component is provided as the resonant-frequency adjusting element.
Figure 6C:
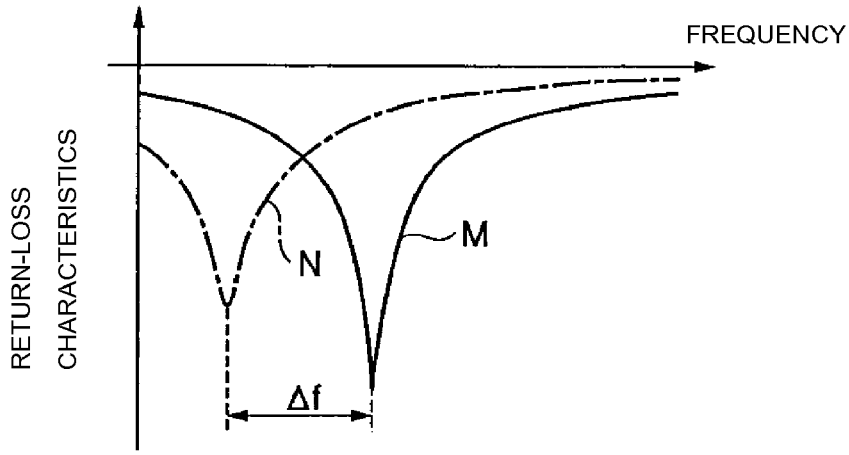
FIG. 6C is a graph for explaining, together with FIGS. 6A and 6B, an example of the relationship between the position of disposing a resonant-frequency adjusting element and the resonant frequency of an antenna structure in a case where a capacitor component is provided as the resonant-frequency adjusting element.

In the second preferred embodiment, the resonant-frequency adjusting element 8 is provided at one of the plurality of predetermined disposing positions. Depending on the position where the resonant-frequency adjusting element 8 is disposed, the amount of change in the resonant frequency of the antenna structure 1 relative to the amount of change in the capacitance or inductance value of the resonant-frequency adjusting element 8 changes. For example, a graph in FIG. 6A represents an example of return-loss characteristics in a case where the resonant-frequency adjusting element 8, which is a capacitor component, is disposed, for example, at the position where the land 17 shown in FIG. 4 is formed (i.e., at the position closest to the turnback portion 12). A graph shown in FIG. 6B represents an example of return-loss characteristics in a case where the resonant-frequency adjusting element 8 is disposed, for example, at the position where the land 16 is formed. A graph shown in FIG. 6C represents an example of return-loss characteristics in a case where the resonant-frequency adjusting element 8 is disposed, for example, at the position where the land 15 is formed. Solid lines M in the graphs shown in FIGS. 6A to 6C represent an example of return-loss characteristics of the antenna structure 1 in a case where the capacitance of the resonant-frequency adjusting element 8 is about 0.5 pF. Chain lines N represent an example of return-loss characteristics of the antenna structure 1 in a case where the capacitance of the resonant-frequency adjusting element 8 is about 1.5 pF.

As shown in the graphs in FIGS. 6A to 6C, when the capacitance of the resonant-frequency adjusting element 8 is changed in the same way, for example, from about 0.5 pF to about 1.5 pF, as the gap between the turnback portion 12 and the position where the resonant-frequency adjusting element 8 is disposed increases and the amount of shortcut of the ground line 7 by the resonant-frequency adjusting element 8 increases accordingly, the amount of change Δf in the resonant frequency of the antenna structure 1 increases.

Figure 5:
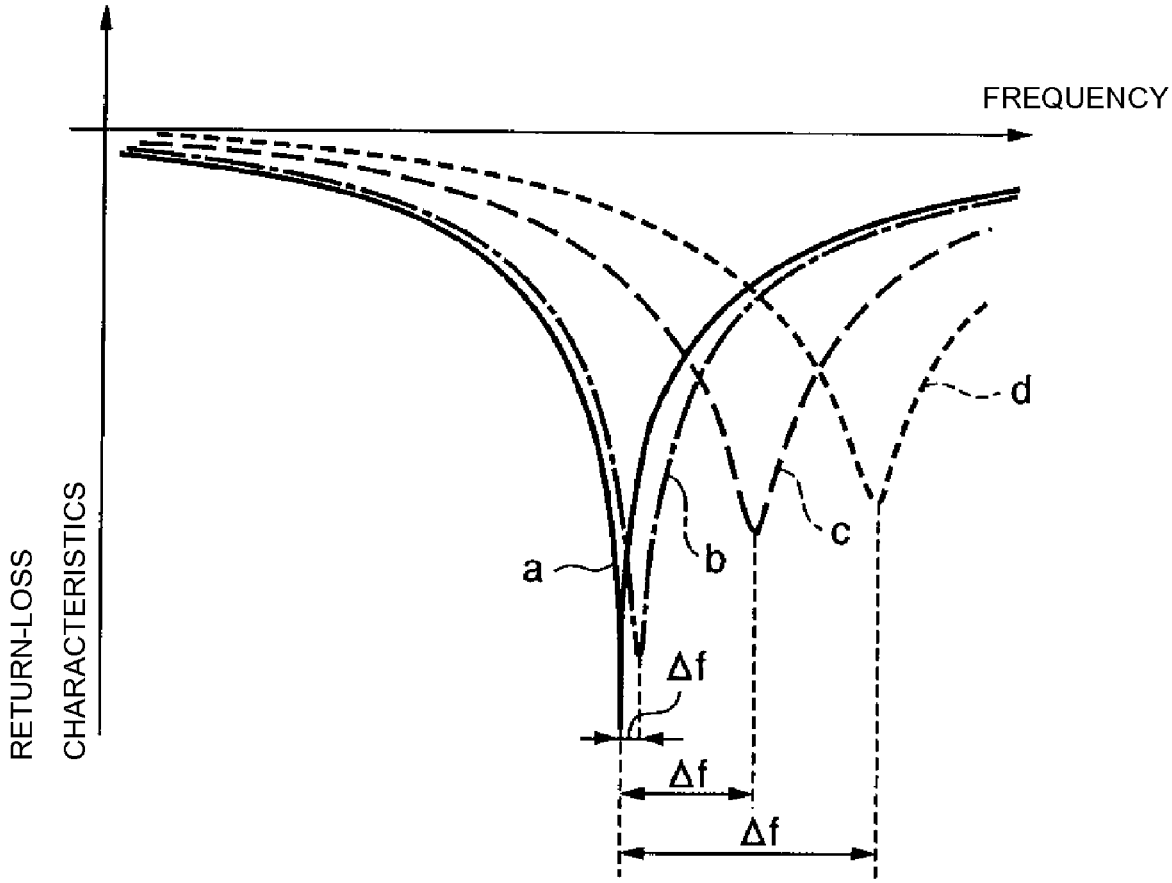
FIG. 5 is a graph for explaining an example of relationship between the position of disposing a resonant-frequency adjusting element and the resonant frequency of an antenna structure in a case where an inductor component is provided as the resonant-frequency adjusting element.

This similarly applies to a case where the resonant-frequency adjusting element 8 is implemented by an inductor component. More specifically, broken lines b to d in a graph in FIG. 5 represent examples of return-loss characteristics of the antenna structure 1 in cases where the resonant-frequency adjusting element 8 is about 6.8 nH. The broken line b represents an example of return-loss characteristics in a case where the resonant-frequency adjusting element 8 is disposed, for example, at the position where the land 17 shown in FIG. 4 is formed (i.e., at the position closest to the turnback portion 12). The broken line c represents an example of return-loss characteristics in a case where the resonant-frequency adjusting element 8 is disposed, for example, at the position where the land 16 is formed. The broken line d represents return-loss characteristics in a case where the resonant-frequency adjusting element 8 is disposed, for example, at the position where the land 15 is formed. On the other hand, a solid line a in the graph in FIG. 5 represents an example of return-loss characteristics of the antenna structure 1 in a case where the resonant-frequency adjusting element 8 is about 22 nH. In this example, when the resonant-frequency adjusting element 8 is about 22 nH, the effect of the resonant-frequency adjusting element 8 on the ground line 7 is so small that the antenna structure 1 exhibits substantially the same return-loss characteristics regardless of whether the resonant-frequency adjusting element 8 is disposed at which of the positions where the lands 15 to 17 are formed.

As shown in the graph in FIG. 5, when the value of inductance of the resonant-frequency adjusting element 8 is changed in the same way, for example, from about 22 nH to about 6.8 nH, as the gap between the turnback portion 12 and the position where the resonant-frequency adjusting element 8 is disposed increases and the amount of shortcut of the ground line 7 by the resonant-frequency adjusting element 8 increases accordingly, the amount of change Δf in the resonant frequency of the antenna structure 1 increases.

That is, when the capacitance or the value of inductance of the resonant-frequency adjusting element 8 is changed in the same way, as the position where the resonant-frequency adjusting element 8 is disposed becomes more remote from the turnback portion 12, the amount of change in the resonant frequency of the antenna structure 1 relative to the amount of change in the capacitance or inductance value of the resonant-frequency adjusting element 8 increases. Thus, it is possible to delicately adjust the resonant frequency of the antenna structure 1, for example, by disposing the resonant-frequency adjusting element 8 at a position in proximity to the turnback portion 12 of the ground line 7 and changing the capacitance or inductance value of the resonant-frequency adjusting element 8. Furthermore, it is possible to roughly adjust the resonant frequency of the antenna structure 1 by disposing the resonant-frequency adjusting element 8 at a position remote from the turnback portion 12 of the ground line 7 and changing the capacitance or inductance value of the resonant-frequency adjusting element 8.

In consideration of what has been described above, in the second preferred embodiment, the disposing position and the magnitude of capacitance or the value of inductance of the resonant-frequency adjusting element 8 are changed and adjusted so that the resonant frequency of the antenna structure 1 is set to a predetermined resonant frequency.

Now, a third preferred embodiment will be described. The third preferred embodiment relates to a wireless communication device. In the wireless communication device according to the third preferred embodiment, the antenna structure 1 according to the first preferred embodiment or the second preferred embodiment is provided. The construction of the wireless communication device may vary, and any construction may be used for the wireless communication device except for the antenna structure 1, and description of the construction will be omitted herein. Furthermore, since the construction of the antenna structure 1 has been described in the context of the first or second preferred embodiments, repeated description thereof will be omitted.

The present invention is not limited to the first to third preferred embodiments, and may be embodied in various forms. For example, although only one resonant-frequency adjusting element 8 is preferably provided on the ground line 7 in the first to third preferred embodiments, a plurality of resonant-frequency adjusting elements 8 may be provided on the ground line 7. When a plurality of resonant-frequency adjusting elements 8 is provided on the ground line 7, the magnitudes of capacitances or the values of inductances of the individual resonant-frequency adjusting elements 8, the distances between the turnback portion 12 and the positions where the individual resonant-frequency adjusting elements 8 are disposed, and the gaps between the individual resonant-frequency adjusting elements 8 are changed and adjusted appropriately so that the resonant frequency of the antenna structure 1 is set to a predetermined resonant frequency.

Figure 7:
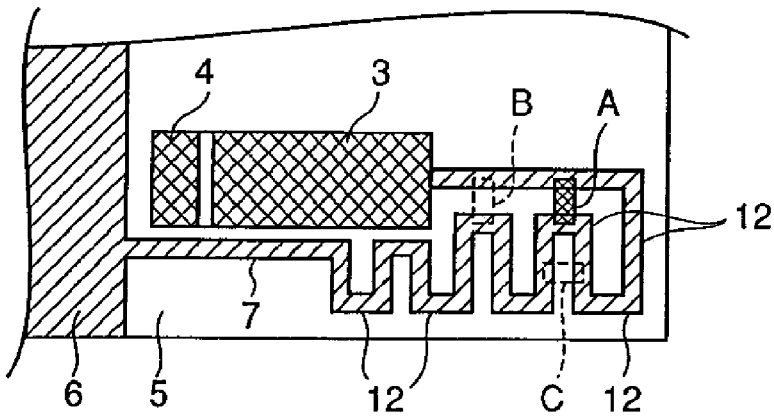
FIG. 7 is a model diagram for explaining another preferred embodiment of the present invention.

Furthermore, although the ground line 7 is preferably U-shaped so as to have only one turnback portion 12 in the first to third preferred embodiments, for example, when it is desired to increase the length of the ground line 7 and decrease the resonant frequency of the antenna structure 1, or depending on restriction of space of the non-ground region where the ground line 7 can be formed, the ground line 7 may be configured so as to have two or more turnback portions 12. For example, as shown in a model diagram in FIG. 7, the ground line 7 may have a meandering shape. When the ground line 7 has a meandering shape as shown in FIG. 7, it is possible to adjust the resonant frequency of the antenna structure 1 by disposing the resonant-frequency adjusting element 8, for example, at a position A, a position B, or a position C shown in FIG. 7.

Since the amount of shortcut of the ground line 7 by the resonant-frequency adjusting element 8 is larger in a case where the resonant-frequency adjusting element 8 is disposed at the position B than in a case where the resonant-frequency adjusting element 8 is disposed at the position A, the amount of change in the resonant frequency of the antenna structure 1 relative to the amount of change in the magnitude of capacitance or the value of inductance of the resonant-frequency adjusting element 8 can be increased. Also, since the amount of shortcut of the ground line 7 by the resonant-frequency adjusting element 8 at the position C is smaller than in a case where the resonant-frequency adjusting element 8 is disposed at the position A or the position B, by disposing the resonant-frequency adjusting element 8 at the position C, delicate adjustment or fine tuning of the resonant frequency of the antenna structure 1 is facilitated compared with a case where the resonant-frequency adjusting element 8 is disposed at the position A or the position B.

A plurality of resonant-frequency adjusting elements 8 may be disposed on the ground line 7 also when the ground line 7 is shaped so as to have two or more turnback portions 12.

Furthermore, although the radiating electrode 3 preferably has a shape as shown in FIG. 1 in the first to third preferred embodiments, the shape of the radiating electrode 3 is not limited to the shape shown in FIG. 1 as long as it is configured so as to perform capacitive power feeding. Furthermore, the shape of the substrate 2 is not limited to a substantially rectangular-parallelepiped shape, and may have shapes other than a substantially rectangular-parallelepiped shape, such as cylindrical shape or polygonal prism shape.

According to various preferred embodiments of the present invention, it is readily possible to carry out wireless communications precisely in a predetermined frequency band while suppressing increase in the size of an antenna structure. This is effective in application to an antenna structure or a wireless communication device that requires miniaturization.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. An antenna structure comprising:

a circuit board having a ground electrode thereon and including a non-ground region;

a substrate mounted on the non-ground region of the circuit board;

a capacitive-power-feeding radiating electrode performing an antenna operation provided on the substrate; and a ground line arranged to electrically connect the ground electrode provided on the circuit board and located adjacent to the non-ground region with the radiating electrode of the substrate, the ground line being provided in the non-ground region of the circuit board with the substrate mounted thereon; wherein the ground line is configured to include at least one turnback portion, a resonant-frequency adjusting element is provided on the ground line so as to connect adjacent line portions having a gap therebetween formed by the turnback of the line at the turnback portion and thereby shortcut a portion of the ground line, and the resonant-frequency adjusting element has a capacitance or inductance so as to adjust a resonant frequency of the antenna structure.

2. The antenna structure according to claim 1, wherein a plurality of positions for disposing the resonant-frequency adjusting element is predetermined between the line portions provided in parallel so as to extend toward and extend away from the turnback portion of the ground line, lands arranged to electrically connect the resonant-frequency adjusting element with the ground line are individually provided at the predetermined positions for disposing the resonant-frequency adjusting element, and the resonant-frequency adjusting element is provided at least one of the plurality of predetermined positions for disposing the resonant-frequency adjusting element so as to define a shortcut connection between the line portions extending toward and extending away from the turnback portion of the ground line.

3. A wireless communication device comprising the antenna structure according to claim 1.

* * * * *